US007377887B1

(12) United States Patent
Rosenow et al.

(10) Patent No.: US 7,377,887 B1
(45) Date of Patent: May 27, 2008

(54) EXERCISE APPARATUS WITH GUIDED MOVEMENT

(75) Inventors: Charles J. Rosenow, Ramsey, MN (US); John M. Cassidy, Elk River, MN (US)

(73) Assignee: Brunswick Corporation, Lake Forest, IL (US)

( * ) Notice: Subject to any disclaimer, the term of this patent is extended or adjusted under 35 U.S.C. 154(b) by 812 days.

(21) Appl. No.: 10/831,395

(22) Filed: Apr. 23, 2004

(51) Int. Cl.
*A63B 21/00* (2006.01)

(52) U.S. Cl. ..... 482/134

(58) Field of Classification Search ..... 482/134, 482/92–101
See application file for complete search history.

(56) References Cited

U.S. PATENT DOCUMENTS 5,056,779 A 10/1991 Webb
5,104,121 A 4/1992 Webb
7,052,446 B2 * 5/2006 Morris et al. ..... 482/100

* cited by examiner

*Primary Examiner*—Lori Amerson
(74) *Attorney, Agent, or Firm*—Andrus, Sceales, Starke & Sawall, LLP

(57) ABSTRACT

Exercise apparatus for guided exercise movement includes a primary arm pivotally mounted to a frame for pivotal movement about a fixed pivot relative to the frame, a movement arm pivotally mounted to the primary arm for pivotal movement relative to the primary arm about a floating pivot relative to the frame, a stationary cam fixed on the frame, and a follower on the movement arm engaging the stationary cam and guided thereby to control the path of movement of the movement arm about the floating pivot during movement of the primary arm about the fixed pivot. The cam has a cam track surface controlling compound movement of the movement arm.

18 Claims, 9 Drawing Sheets

EXERCISE APPARATUS WITH GUIDED MOVEMENT

BACKGROUND AND SUMMARY

The invention relates to exercise apparatus providing guided exercise movement.

Various types of exercise apparatus providing various types of exercise movements are known in the prior art. Drawbacks of such equipment include complicated linkages and multi-part mechanisms used to accomplish desired motion.

The present invention provides exercise apparatus with a simplified mechanism for guided exercise movement. The invention further enables the guided exercise movement along a selectively configurable path.

DETAILED DESCRIPTION

Figure 1:
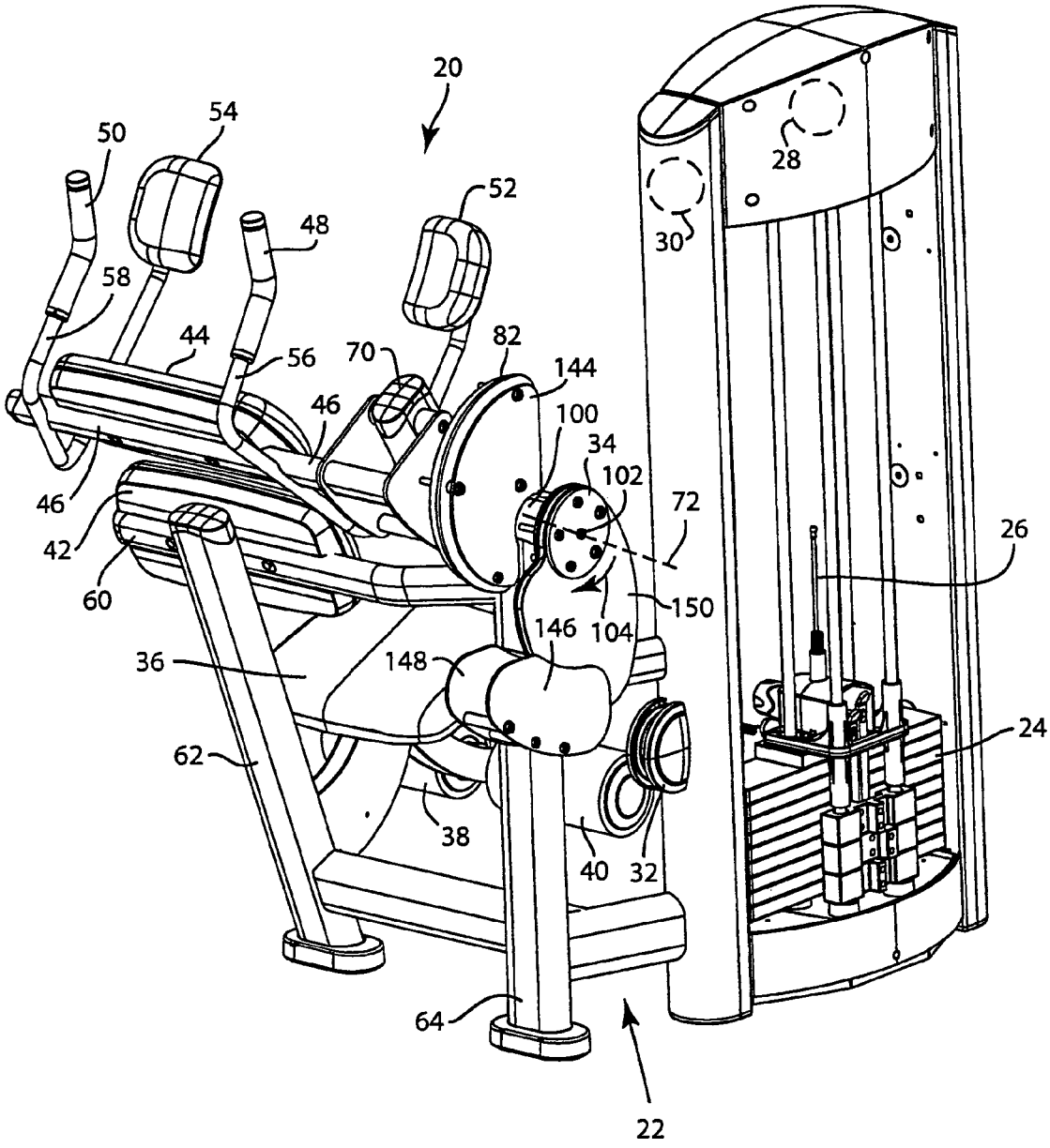
FIG. 1 is a perspective view of exercise apparatus in accordance with the invention.
Figure 2:
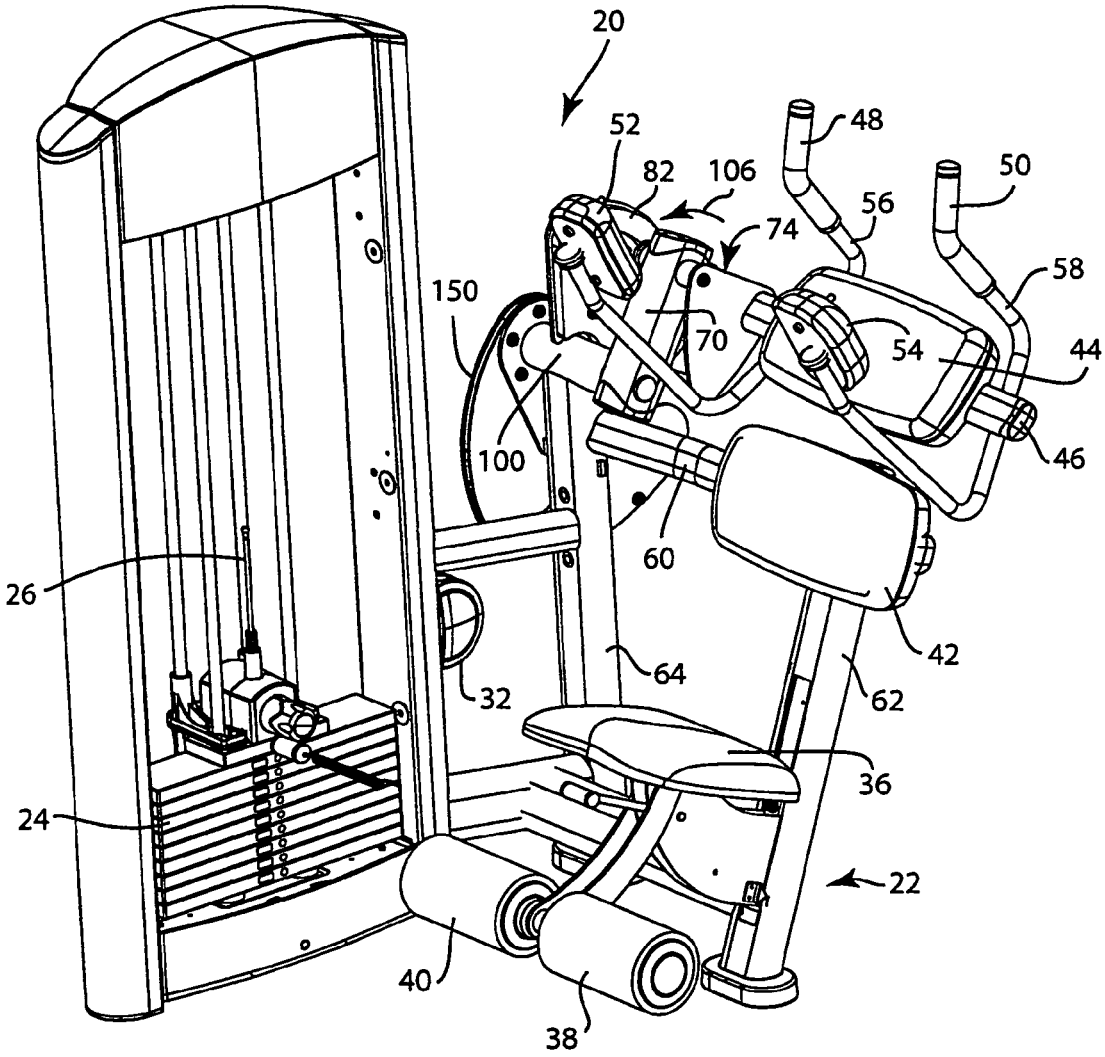
FIG. 2 is another perspective view of the apparatus of FIG. 1.
Figure 3:
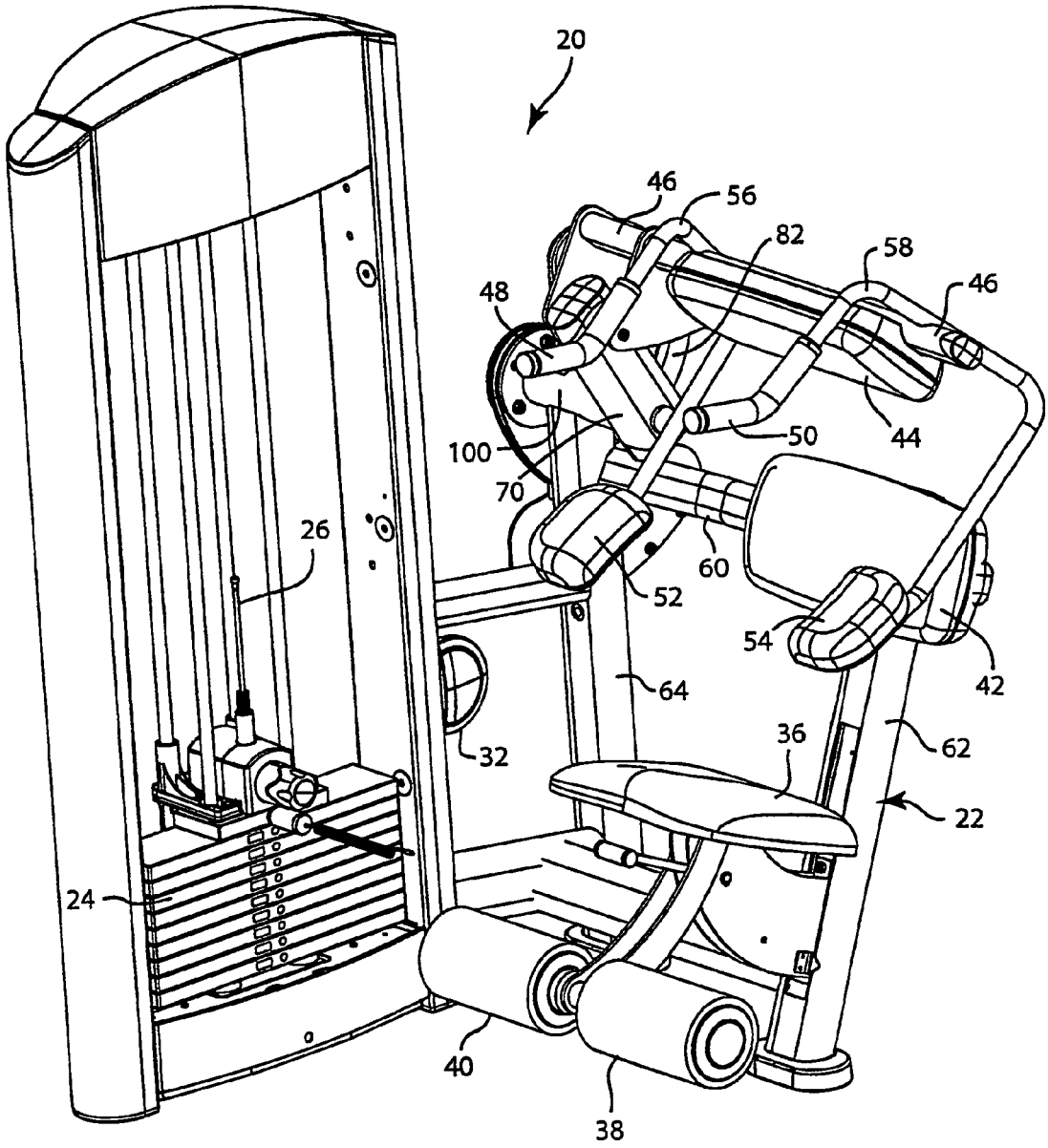
FIG. 3 is like FIG. 2 and shows another position.

FIGS. 1-3 show an exercise apparatus 20 for guided exercise movement, for example an abdominal crunch machine, though the invention is applicable to other exercise apparatus. The apparatus includes a frame 22 having a weight stack 24 connected by a cable 26 through a pulley system having pulleys such as 28, 30, 32, to a retainer plate 34, for providing weight resistance resisting a given movement, as is standard and known in the prior art. The frame has a seat 36, FIG. 2, for the user, and a pair of foot/ankle restraints 38, 40 engaging the front of the legs of the user just above the foot for properly positioning the user. The frame has a stationary lower back rest 42 engaging the lower or middle back of the user. An upper back support 44 engages the upper back of the user at the shoulders and is pivotable forwardly as shown in FIG. 3 to a crunch position, to be described. Upper back rest 44 is mounted on a horizontally extending shaft 46 which may also have handgrips 48, 50 and elbow rests 52, 54 mounted thereto by respective configured support bars 56 and 58. Stationary lower back rest 42 is mounted to the frame at stationary horizontally extending shaft or bar 60 extending between stationary upright posts 62 and 64.

Figure 4:
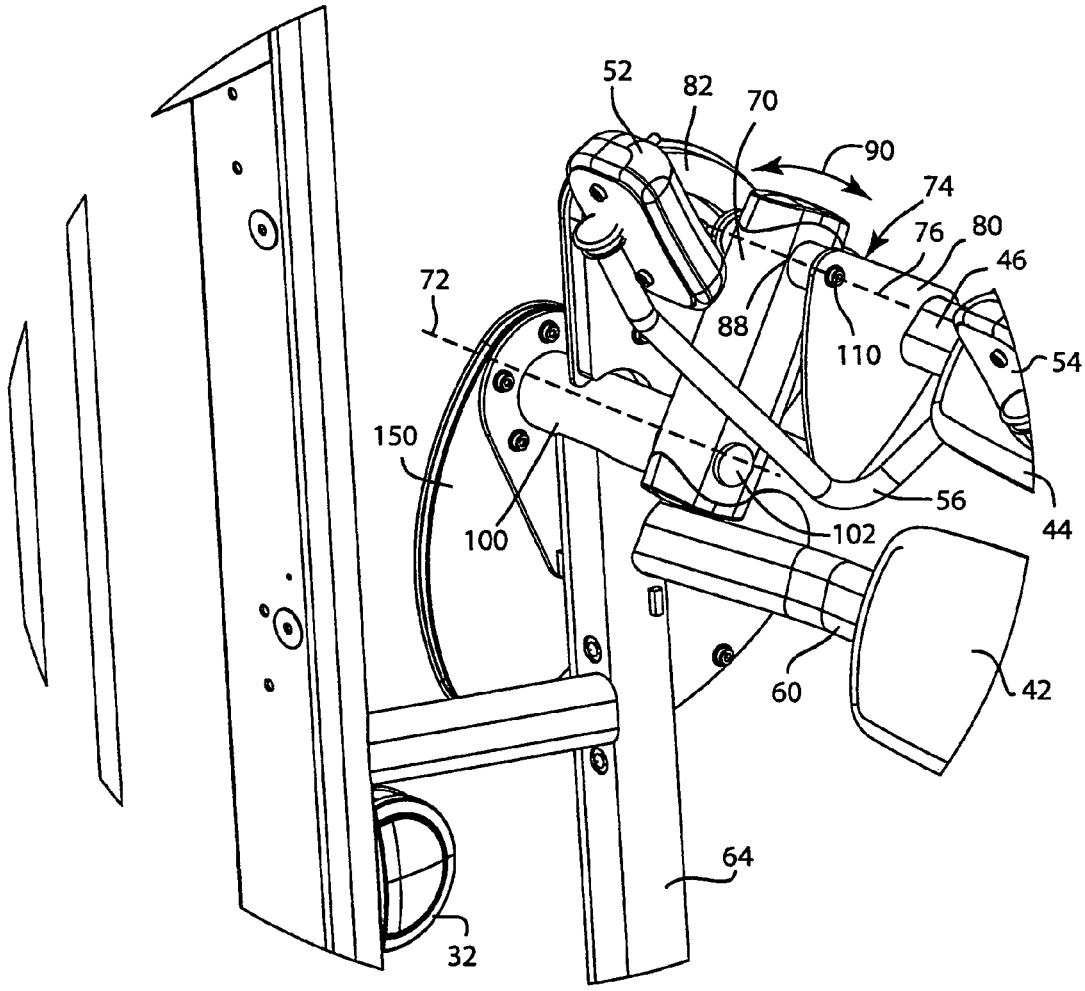
FIG. 4 is an enlarged view of a portion of FIG. 2.
Figure 5:
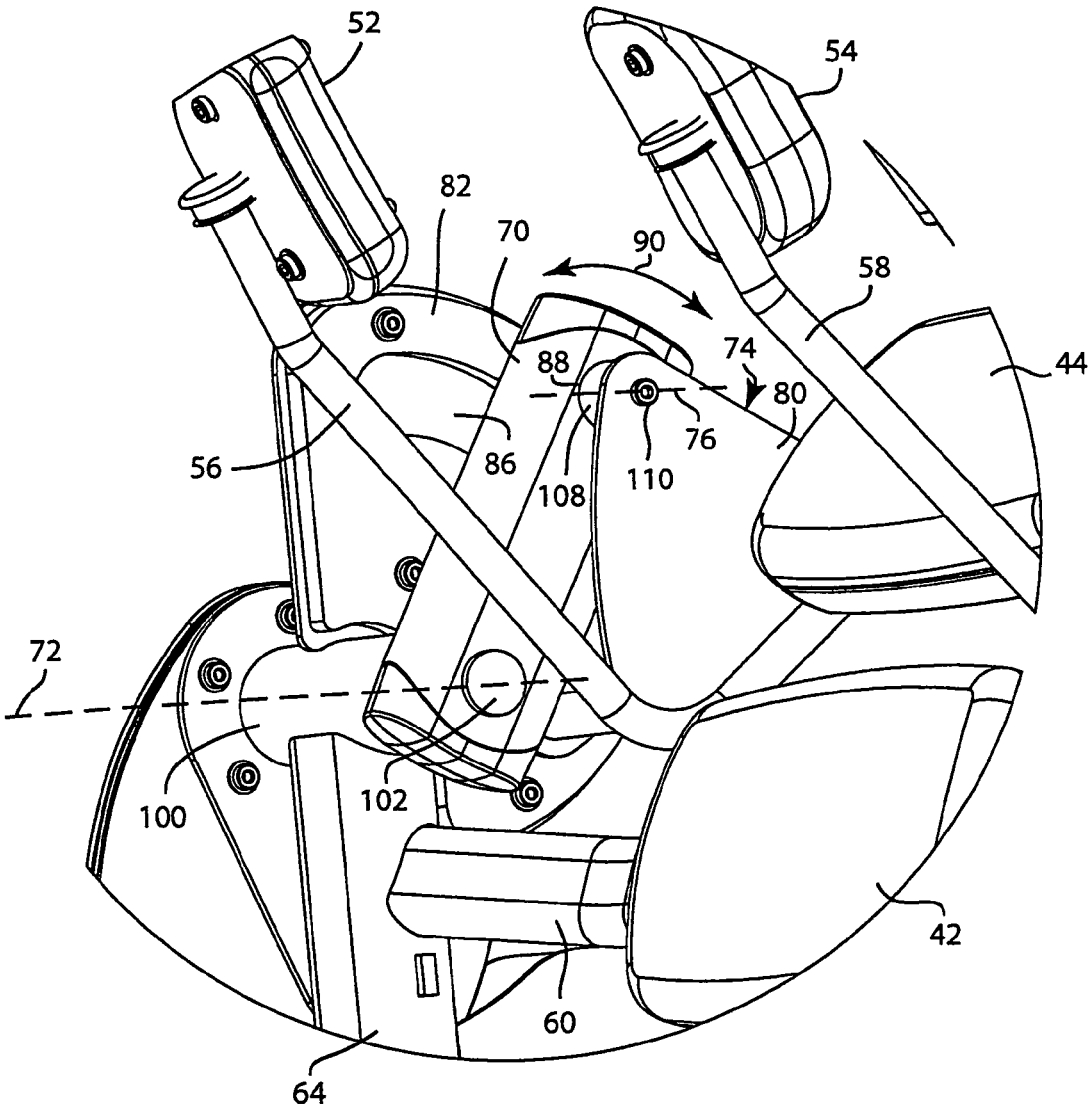
FIG. 5 is another enlarged view of a portion of FIG. 2.
Figure 6:
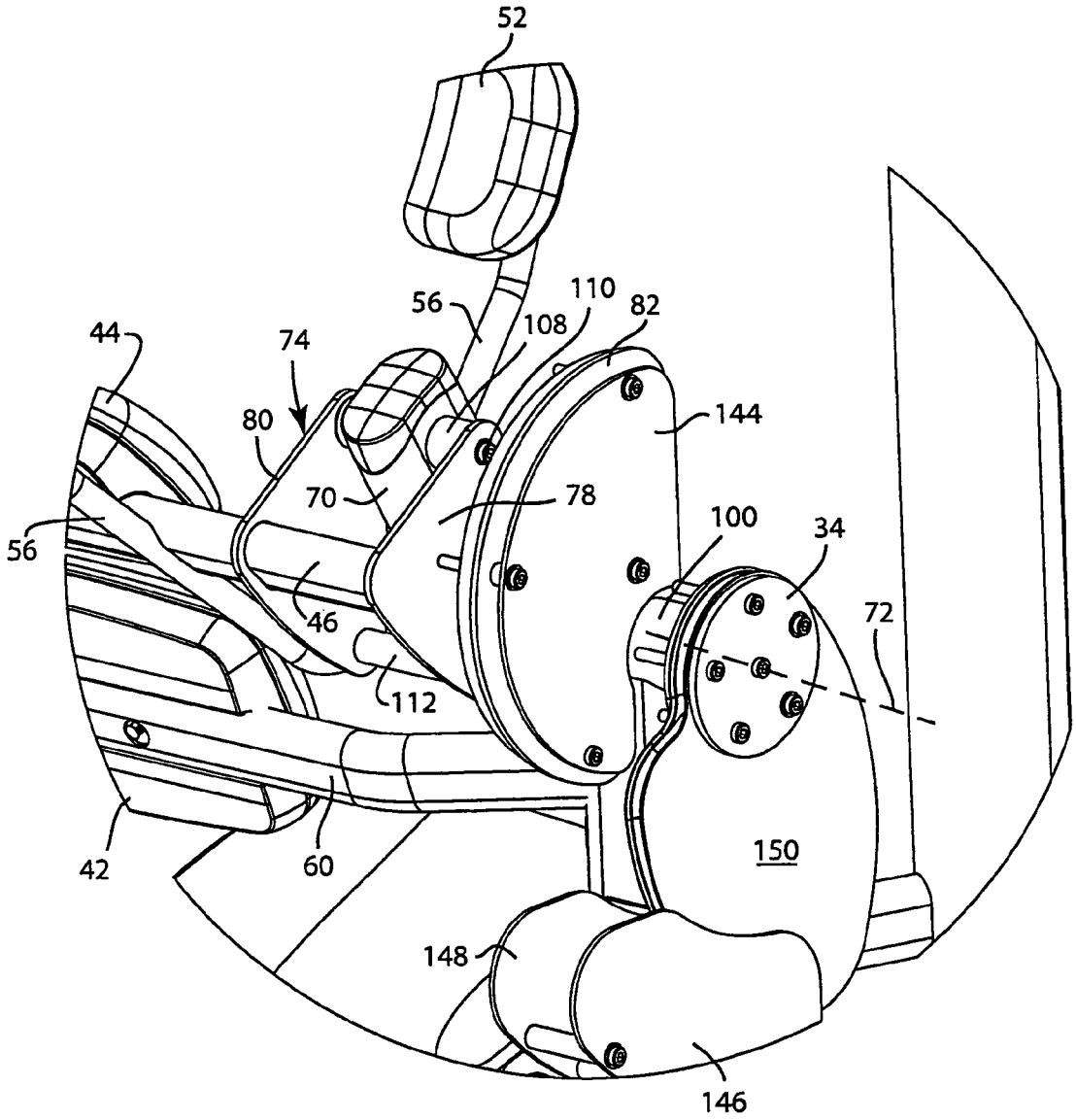
FIG. 6 is an enlarged view of a portion of FIG. 1.
Figure 7:
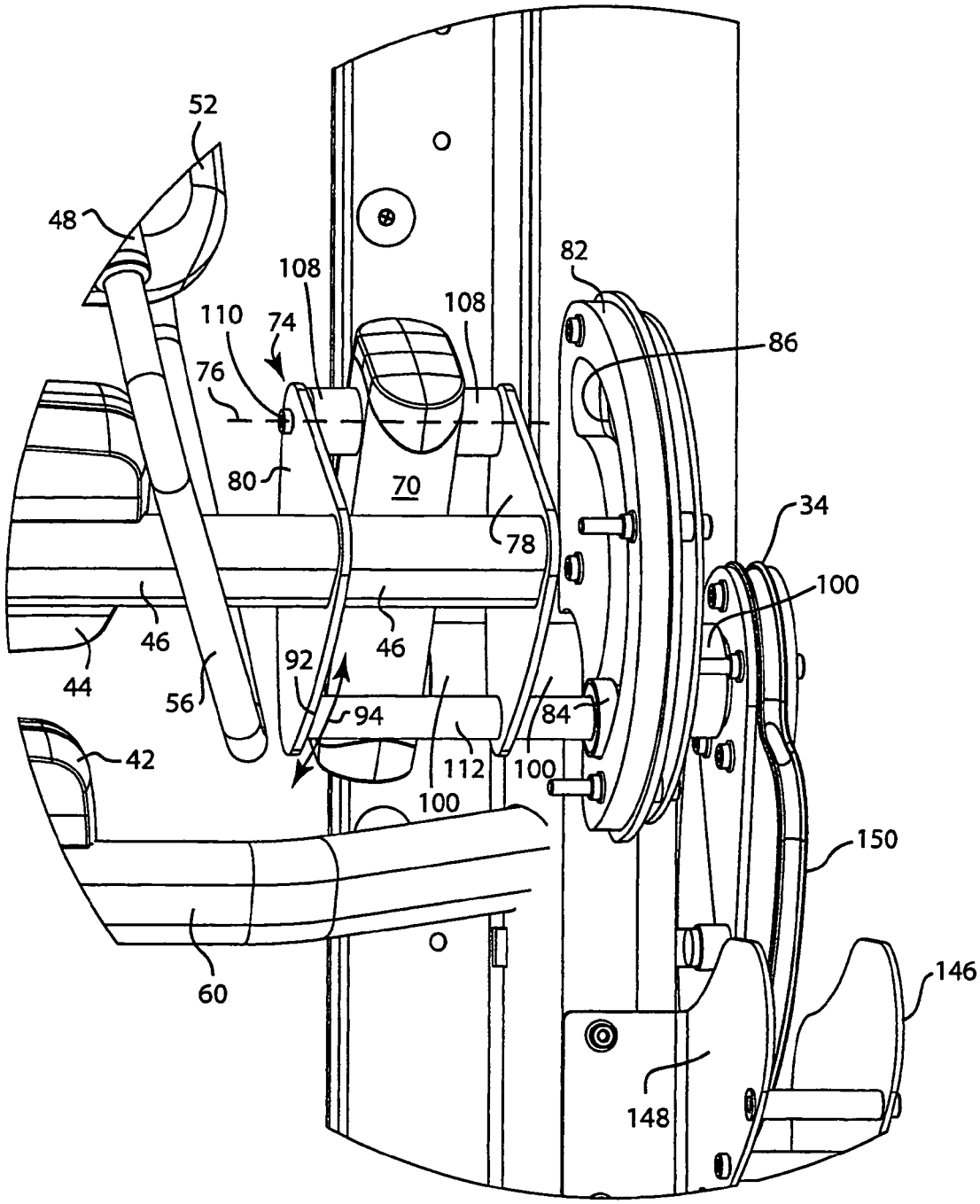
FIG. 7 is a view like FIG. 6 from another angle.
Figure 8:
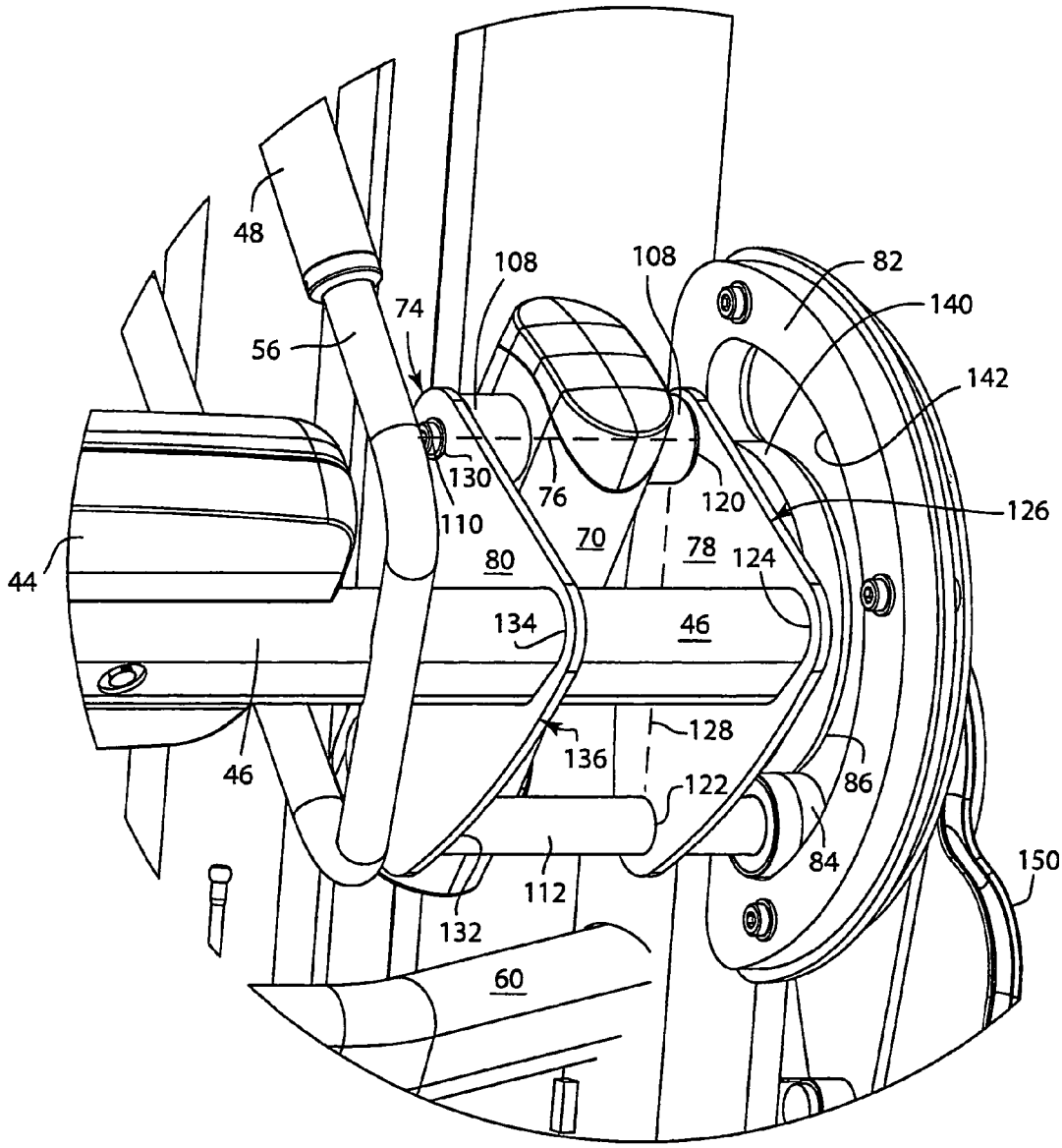
FIG. 8 is a view like FIG. 7 from another angle.

The exercise apparatus has a primary arm 70, FIGS. 4, 5, pivotally mounted to the frame at post 64 for pivotal movement relative to the frame about a fixed pivot along a fixed pivot axis 72. A movement arm 74 is pivotally mounted to primary arm 70 for pivotal movement relative to the primary arm about a floating pivot along floating pivot axis 76 relative to the frame. The movement arm is provided by a pair of members or plates 78 and 80, FIGS. 6-8, on opposite axial sides of primary arm 70. A stationary cam 82 is fixed on the frame at the top of post 64. A follower 84, FIGS. 7, 8, is provided on movement arm 74 and engages stationary cam 82 at cam track 86 and is guided thereby to control the path of movement of movement arm 74 about floating pivot 76 during movement of primary arm 70 about fixed pivot 72.

Figure 9:
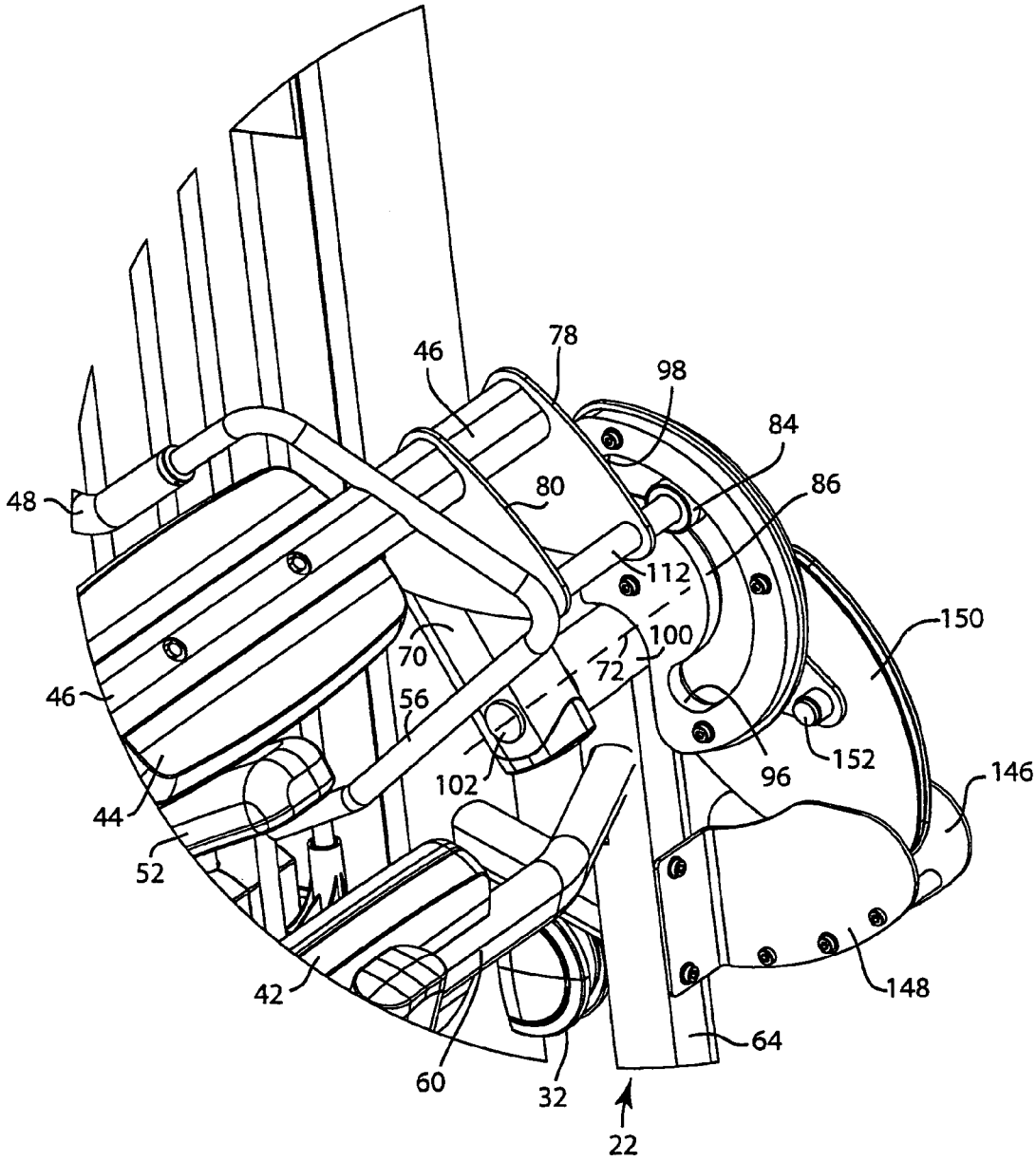
FIG. 9 is like FIG. 8 and shows another position.

Primary arm 70 is mounted to frame 22 along the noted axially extending fixed pivot axis 72. Movement arm 74 is mounted to primary arm 70 at a point 88, FIGS. 4, 5, along primary arm 70 laterally spaced from fixed pivot axis 72 and defining the noted axially extending floating pivot axis 76 laterally spaced from fixed pivot axis 72 and movable in a first arc 90 about fixed pivot axis 72 during movement of primary arm 70. Follower 84 is mounted to movement arm 74 at a point 92, FIG. 7, along movement arm 74 laterally spaced from floating pivot axis 76 and moveable in a second arc 94 defined by compound movement comprising pivotal movement of primary arm 70 about fixed pivot axis 72 in combination with pivotal movement of movement arm 74 about floating pivot axis 76. Stationary cam 82 includes the noted cam track 86 engaged by follower 84 and guiding follower 84 along a selectively configured arc 94 controlled by a selectively configured cam track 86 to selectively control and configure the path of movement of a user engagement surface such as upper back rest 44 on shaft 46 extending from movement arm 74, to provide guided exercise movement of shaft 46 and the user engagement surfaces mounted thereto, such as backrest 44, handgrips 48, 50, and elbow rests 52, 54, along a path selectively configured according to cam track 86. Cam track 86 defines an eccentric arc 94 relative to fixed pivot axis 72. Cam track 86 has first and second stops 96 and 98, FIG. 9, defining the limit of travel of follower 84. Limit stop 96 corresponds to the rest position, FIGS. 1, 2. Limit stop 98 corresponds to the crunch position, FIG. 3. Limit stop 96 is radially spaced from fixed pivot axis 72 by a first radial distance. Limit stop 98 is radially spaced from fixed pivot axis 72 by a second radial distance. The noted second radial distance is greater than the noted first radial distance.

Primary arm 70 is pivotally mounted to the frame by a tubular shaft 100 extending axially along axis 72 and having an internally journaled axle 102 mounted at one axial end to primary arm 70 and mounted at its other axial end to retainer plate 34, for pivotal movement of primary arm 70 relative to frame 22 upon rotation of retainer plate 34 about axis 72. For example, rotation of retainer plate 34 clockwise in FIG. 1 as shown at arrow 104 pulls cable 26 trained around pulleys 32, 30, 28 to lift one or more of the weights in weight stack 24 to thus provide weight resistance resisting clockwise rotation 104 of retainer plate 34 and thus resist pivoting of primary arm 70 in the direction of arrow 106, FIG. 2, to thus provide resistance to the crunch movement of movable back rest 44 from the rest position of FIG. 2 to the crunch position of FIG. 3. Movement arm 74 is pivotally mounted to primary arm 70 by an axially extending shaft 108 having an internally journaled axle 110 mounted at one axial end to plate 80 and at the other axial end to plate 78, for pivotal movement of movement arm 74, including plates 78 and 80, relative to primary arm 70. Follower 84 is on a fixed shaft 112, FIGS. 7, 8, extending axially from movement arm 74 to stationary cam 82 such that follower 84 is in cam track 86. Movement arm 74 has another fixed shaft, as noted above at 46, extending axially therefrom and having the noted one or more user engagement surfaces 44, 48, 50, 52, 54 providing the noted guided exercise movement. First, second, third, fourth shafts 100, 108, 112, 46, respectively, are parallel to each other and laterally spaced from each other. Shaft 112 mounts follower 84 to movement arm 74 in a fixed position relative thereto without pivotal movement of follower 84 relative to movement arm 74. Follower 84 may be a roller rotational about shaft 112. Shaft 46 mounts the noted user engagement surfaces to movement arm 74 in a fixed position relative thereto without pivotal movement of such user engagement surfaces relative to movement arm 74. In other embodiments, one or more of the user engagement surfaces may be movably mounted to shaft 46 for movement relative to movement arm 74.

Shaft 100 extends in a first axial direction (rightwardly in FIGS. 4, 5; leftwardly in FIGS. 6-9) from the frame to primary arm 70. Shaft 112 extends from movement arm 74 to follower 84 in a second axial direction (rightwardly in FIGS. 6-9) opposite to the noted first axial direction. Shaft 46 extends in the noted first axial direction (leftwardly in FIGS. 6-9) from movement arm 74 to the noted user engagement surfaces. Shaft 108 extends in at least one and preferably both of the noted axial directions from primary arm 70, i.e. movement arm 74 is preferably provided by axially spaced plates 78 and 80 on opposite axial sides of primary arm 70, and shaft 108 extends from primary arm 70 in the noted first axial direction to plate 80 and also extends in the noted second axial direction from primary arm 70 to plate 78. Primary arm 70 is axially spaced between stationary cam 82 and the noted user engagement surfaces. Movement arm 74 is axially spaced between stationary cam 82 and the noted user engagement surfaces. Plate 78 of movement arm 74 is axially spaced between stationary cam 82 and primary arm 70. Plate 80 of movement arm 74 is axially spaced between primary arm 70 and the noted user engagement surfaces.

As above noted, movement arm 74 is preferably provided by first and second members or plates 78 and 80 axially spaced on opposite sides of primary arm 70 and connected to each other by the noted shafts 108, 112, 46. Member or plate 78, FIG. 8, has three laterally spaced attachment points 120, 122, 124 defining three apexes of a triangle 126. First attachment point 120 provides a first apex from which the noted second shaft 108 extends axially. Second attachment point 122 provides a second apex from which the noted third shaft 112 extends axially. Third attachment point 124 provides a third apex from which the noted fourth shaft 46 extends axially. Triangle 126 pivots at first apex 120 about the noted floating pivot point along floating pivot axis 76 at the noted second axle 110. First and second apexes 120 and 122 define a leg 128 of triangle 126 extending therebetween. Primary arm 70 extends between the noted first and second axles 102 and 110 on a first lateral side of leg 128. The noted fourth shaft 46 extends from the noted third apex 124 on a second lateral side of leg 128 opposite the noted first lateral side. Plate 80 has three laterally spaced attachment points 130, 132, 134 defining three apexes of a second triangle 136, providing a fourth attachment point 130 providing a fourth apex from which the noted second shaft 108 extends axially, a fifth attachment point 132 providing a fifth apex from which the noted third shaft 112 extends axially, and a sixth attachment point 134 providing a sixth apex from which the noted fourth shaft 46 extends axially. Triangle 136 pivots at fourth apex 130 about the noted floating pivot along floating pivot axis 72 at the noted second axle 110. Triangles 126 and 136 pivot in unison about the floating pivot at floating pivot axis 76 at axle 110.

Stationary cam 82 fixed on frame 22 is engaged by follower 84 and guides the follower along an eccentric arcuate path relative to the noted fixed pivot at fixed pivot axis 72 and controls compound movement due to pivoting of primary arm 70 about the fixed pivot in combination with pivoting of movement arm 74 about the noted floating pivot at floating pivot axis 76. Stationary cam 82 has a cam surface at 86 controlling the path of movement of movement arm 74 about floating pivot axis 76 during movement of primary arm 70 about fixed pivot axis 72. The cam track at 86 has inner and outer radial spaced arcuate cam surfaces 140, 142, respectively, FIG. 8, trapping follower 84 radially therebetween and guiding follower 84 along the noted eccentric arcuate path and controlling the noted compound movement. The stationary cam may have a protective cover or guard 144 mounted thereto to block access by the user or others to follower 84 moving along track 86. Protective guards or plates such as 146, 148 may be provided along the path of cable travel as it engages eccentric cam plate 150 on retainer plate 34. Plate 150 may have a stud 152 thereon for engaging post 64 of the frame to provide a stop for return movement of the cable.

It is recognized that various equivalents, alternatives and modifications are possible within the scope of the appended claims. For example, member 82 including track 86 may be provided on movement arm 74, and member 84 may be stationary and fixed on frame 22, in which case member 84 is the cam, and member 82 is the follower.

What is claimed is:

1. Exercise apparatus for guided exercise movement, comprising a frame, a primary arm pivotally mounted to said frame for pivotal movement relative to said frame about a fixed pivot relative to said frame, a movement arm pivotally mounted to said primary arm for pivotal movement relative to said primary arm about a floating pivot relative to said frame, a stationary cam fixed on said flame, a follower on said movement arm engaging said stationary cam and guided thereby to control the path of movement of said movement arm about said floating pivot during movement of said primary arm about said fixed pivot, wherein:

said primary arm is mounted to said frame along an axially extending fixed pivot axis;

said movement arm is mounted to said primary arm at a point along said primary arm laterally spaced from said fixed pivot axis and defining an axially extending floating pivot axis laterally spaced from said fixed pivot axis and movable in a first arc about said fixed pivot axis during movement of said primary arm;

said follower is mounted to said movement arm at a point along said movement arm laterally spaced from said floating pivot axis and movable in a second arc defined by compound movement comprising pivotal movement of said primary arm about said fixed pivot axis in combination with pivotal movement of said movement arm about said floating pivot axis;

said stationary cam comprises a cam track engaged by said follower and guiding said follower along a selectively configured said second arc controlled by a selectively configured said cam track to selectively control and configure the path of movement of a user engagement surface extending from said movement arm, to provide said guided exercise movement along a path selectively configured according to said cam track.

2. The exercise apparatus according to claim 1 wherein said cam track defines an eccentric said second arc relative to said fixed pivot axis.

3. The exercise apparatus according to claim 2 wherein said cam track has first and second limit stops defining the limit of travel of said follower, said first limit stop being radially spaced from said fixed pivot axis by a first radial distance, said second limit stop being radially spaced from said fixed pivot axis by a second radial distance, said second radial distance being greater than said first radial distance.

4. Exercise apparatus for guided exercise movement, comprising a frame, a primary arm pivotally mounted to said frame for pivotal movement relative to said frame about a fixed pivot relative to said frame, a movement arm pivotally mounted to said primary arm for pivotal movement relative to said primary arm about a floating pivot relative to said frame a stationary cam fixed on said frame, a follower on said movement arm engaging said stationary cam and guided thereby to control the path of movement of said movement arm about said floating pivot during movement of said primary arm about said fixed pivot, wherein:

said primary arm is pivotally mounted to said frame by a first shaft extending axially along an axis and providing a first axle for pivotal movement of said primary arm relative to said frame;

said movement arm is pivotally mounted to said primary arm by a second axially extending shaft providing a second axle for pivotal movement of said movement arm relative to said primary arm;

said follower is on a third shaft extending axially from said movement arm to said stationary cam;

said movement arm has a fourth shaft extending axially therefrom and having a user engagement surface providing said guided exercise movement.

5. The exercise apparatus according to claim 1 wherein said first, second, third and fourth shafts are parallel to each other.

6. The exercise apparatus according to claim 5 wherein each of said shafts is laterally spaced from each of the remaining said shafts.

7. The exercise apparatus according to claim 4 wherein:

said third shaft mounts said follower to said movement arm in a fixed position relative thereto without pivotal movement of said follower relative to said movement arm;

said fourth shaft mounts said user engagement surface to said movement arm in a fixed position relative thereto without pivotal movement of said user engagement surface relative to said movement arm.

8. The exercise apparatus according to claim 4 wherein said first shaft extends in a first axial direction from said frame to said primary arm, said third shaft extends from said movement arm to said follower in a second axial direction opposite to said first axial direction, said fourth shaft extends in said first axial direction from said movement arm to said user engagement surface, said second shaft extends in at least one of said first and second axial directions from said primary arm.

9. The exercise apparatus according to claim 8 wherein said primary arm is axially spaced between said stationary cam and said user engagement surface.

10. The exercise apparatus according to claim 8 wherein said movement arm is axially spaced between said stationary cam and said user engagement surface.

11. The exercise apparatus according to claim 8 wherein said movement arm is axially spaced between said stationary cam and said primary arm.

12. The exercise apparatus according to claim 8 wherein said movement arm is axially spaced between said primary arm and said user engagement surface.

13. The exercise apparatus according to claim 8 wherein said movement arm comprises first and second members axially spaced on opposite sides of said primary arm and connected to each other by at least one of said second, third and fourth shafts extending axially therebetween.

14. The exercise apparatus according to claim 4 wherein said movement arm comprises a member having three laterally spaced attachment points defining three apexes of a triangle, comprising a first attachment point providing a first apex from which said second shaft extends axially, a second attachment point providing a second apex from which said third shaft extends axially, and a third attachment point providing a third apex from which said fourth shaft extends axially, said triangle pivoting at said first apex about said floating pivot point at said second axle.

15. The exercise apparatus according to claim 14 wherein said first and second apexes define a leg of said triangle extending therebetween, and wherein said primary arm extends between said first and second axles on a first lateral side of said leg, and said fourth shaft extends from said third apex on a second lateral side of said leg opposite said first lateral side.

16. The exercise apparatus according to claim 14 wherein said movement arm comprises first and second plates axially spaced by said primary arm therebetween along said second axle, said second shaft extends axially in one axial direction from said primary arm to said first plate, said second shaft extends axially in the opposite axial direction from said primary arm to said second plate, said first plate has three laterally spaced attachment points defining three apexes of a first triangle, comprising a first attachment point providing a first apex from which said second shaft extends axially, a second attachment point providing a second apex from which said third shaft extends axially, and a third attachment point providing a third apex from which said fourth shaft extends axially, said first triangle pivoting at said first apex about said floating pivot at said second axle, said second plate has three laterally spaced attachment points defining three apexes of a second triangle, comprising a fourth attachment point providing a fourth apex from which said second shaft extends axially, a fifth attachment point providing a fifth apex from which said third shaft extends axially, and a sixth attachment point providing a sixth apex from which said fourth shaft extends axially, said second triangle pivoting at said fourth apex about said floating pivot at said second axle, said first and second triangles pivoting in unison about said floating pivot at said second axle.

17. Exercise apparatus for guided exercise movement, comprising a frame, a primary arm pivotally mounted to said frame for pivotal movement relative to said frame about a fixed pivot relative to said frame, a movement arm pivotally mounted to said primary arm for pivotal movement relative to said primary arm about a floating pivot relative to said frame, a follower on said movement arm, a stationary cam fixed on said frame and engaged by said follower and guiding said follower along an eccentric arcuate path relative to said fixed pivot and controlling compound movement due to pivoting of said primary arm about said fixed pivot in combination with pivoting of said movement arm about said floating pivot, wherein said stationary cam has a cam surface controlling the path of movement of said movement arm about said floating pivot during movement of said primary arm about said fixed pivot.

18. Exercise apparatus for guided exercise movement, comprising a frame, a primary arm pivotally mounted to said frame for pivotal movement relative to said frame about a fixed pivot relative to said frame, a movement arm pivotally mounted to said primary arm for pivotal movement relative to said primary arm about a floating pivot relative to said frame, a follower on said movement arm, a stationary cam fixed on said flame and engaged by said follower and guiding said follower along an eccentric arcuate path relative to said fixed pivot and controlling compound movement due to pivoting of said primary arm about said fixed pivot in combination with pivoting of said movement arm about said floating pivot, wherein said stationary cam comprises a cam track having inner and outer radially spaced arcuate cam surfaces trapping said follower radially therebetween and guiding said follower along said eccentric arcuate path and controlling said compound movement.

* * * * *